United States Patent [19]

Guetle, Jr.

[11] Patent Number: 4,947,585

[45] Date of Patent: Aug. 14, 1990

[54] EXTERIOR DOOR CONSTRUCTION

[75] Inventor: Norbert J. Guetle, Jr., Cincinnati, Ohio

[73] Assignee: Pease Industries, Inc., Fairfield, Ohio

[21] Appl. No.: 268,096

[22] Filed: Nov. 7, 1988

Related U.S. Application Data

[63] Continuation-in-part of Ser. No. 143,543, Jan. 13, 1988, abandoned.

[51] Int. Cl.[5] ..... E06B 7/16

[52] U.S. Cl. ..... 49/478; 49/462

[58] Field of Search ..... 49/462, 478, 460, 493, 49/303; 108/27; 16/82, 86 R; 248/345.1

[56] References Cited

U.S. PATENT DOCUMENTS

| | | | |
|---|---|---|---|
| 2,489,072 | 11/1949 | Ausubel | 49/460 |
| 2,568,153 | 9/1951 | Hickman | 248/345.1 |
| 2,923,571 | 2/1960 | Adell | 49/478 |
| 3,238,573 | 3/1966 | Pease, Jr. | 49/478 X |
| 3,271,919 | 9/1966 | Olton . | |
| 3,353,321 | 11/1967 | Heilweil et al. | 49/478 |
| 3,512,304 | 5/1970 | Meuret . | |
| 4,242,848 | 1/1981 | Schoultz | 49/462 |
| 4,753,042 | 6/1988 | Adkins | 49/478 |

*Primary Examiner*—James R. Brittain

*Attorney, Agent, or Firm*—Wood, Herron, Evans

[57] ABSTRACT

A wooden door for hinged mounting in a frame wherein the door opening is defined by jambs equipped with magnetic weather stripping is characterized by clip-like trim strips of resilient magnetic metal extending in enclosing relation with the corner of each side and the top of the door which enter the frame. These trim strips have the multiple functions of providing a magnetic interconnection between magnetic weather stripping and the otherwise wood door, protecting the corners of the door against damage by contact with foreign objects extending into the door opening, and providing a decorative appearance.

9 Claims, 1 Drawing Sheet

EXTERIOR DOOR CONSTRUCTION

CROSS-REFERENCE TO COPENDING APPLICATION

This application is a continuation-in-part of commonly owned application Ser. No. 143,543, filed Jan. 13, 1988 now abandoned.

BACKGROUND OF THE INVENTION

The development of the present invention has resulted from recognition of the fact that while magnetic weather stripping is highly effective in conjunction with residential doors having an exterior of magnetic metal, it cannot be used with wooden doors - which in many instances are preferred over metal doors. On the other hand, wooden doors exhibit a greater tendency to warpage than metal doors, particularly in cold weather when the humidity conditions on the inside of a residence are commonly substantially higher than the outdoor atmosphere, and it is not unusual for such warpage to break the sealing engagement between a wooden door and the non-magnetic weather stripping which must be used therewith.

Another background fact contributing to the development of the present invention was observation of the fact that an exterior door of wood, and particularly the leading edge thereof, is often subject to damage by contact with foreign objects, especially during construction of the building. Thus it often happens that an attempt is made to close the door while some foreign object is extending through the doorway, such for example as a hose, a rope, a piece of building material or an electric cable such as an extension cable. As a result, the corner of the door which first enters the frame tends to be dented or otherwise disfigured, not only during construction but also after the dwelling has been completed and is in use.

SUMMARY OF THE INVENTION

The present invention has as its primary object the provision of a wooden door, particularly for a residence, with which it is possible and practical to use magnetic weather stripping and which will retain sealing engagement with magnetic weather stripping under all normal conditions of use, notwithstanding warpage of the door. It is also an object of the invention to accomplish this primary objective while also providing protection of a wood door against damage by any foreign object which may be caught between it and the lock side jamb of the door frame, and especially while providing the finished door with a decorative appearance.

In order to accomplish these objectives, the corner of the door along its leading edge is provided with a clip-like trim member of resilient magnetic metal which encloses the corner of the lock side of the door that first enters the door frame and engages the stop portion of the lock side jamb which conventionally establishes the closed position of the door. Similar trim members are also provided along the corresponding corner of the top of the door for magnetic engagement with magnetic weather stripping mounted along the top jamb, and also along the hinge side for uniformity of appearance and protection of that corner of the door.

Each of the trim members of the invention is initially formed with its two sides defining an angle of approximately 90°, and each of its sides is provided with an inturned flange, so that when it is applied to a door and these flanges are inserted in grooves in the face and edge of the door, it is held firmly in place. Preferably, the surfaces of the door between each corner to be enclosed by the trim member and the grooves in which the flanges on the trim member are inserted are relieved to a sufficient extent so that the outer surfaces of the trim member are coplanar with the adjacent surfaces of the door itself.

Details of the structure by which these objectives of the invention are achieved are pointed out in the description of the preferred embodiment of the invention which follows.

BRIEF DESCRIPTION OF THE PREFERRED EMBODIMENTS

Figures 1, 2, 3, 4, 5, 6:
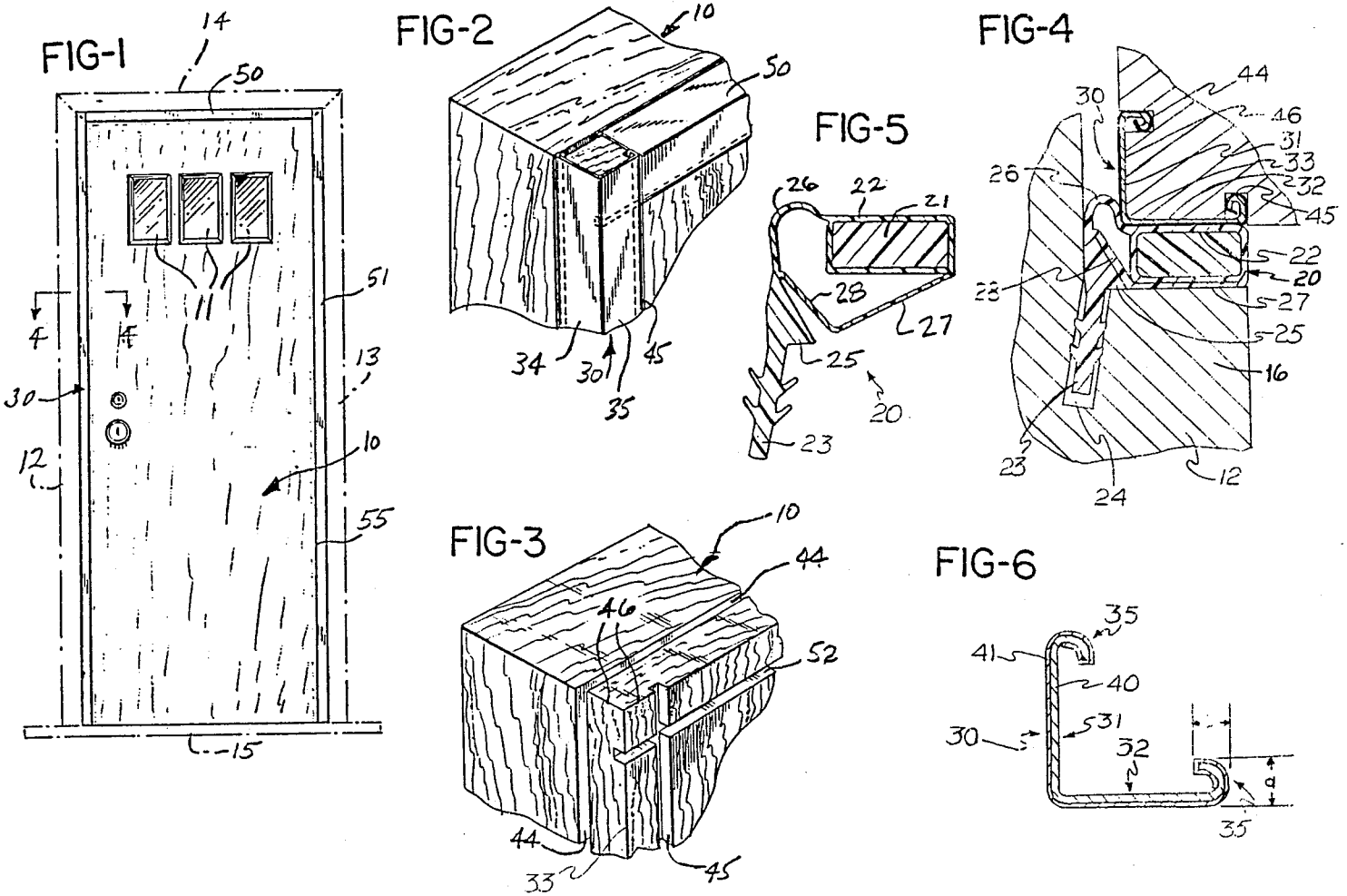
FIG. 1 is an elevation of the outer face of a door constructed in accordance with the invention, and with the door frame shown in phantom.
FIG. 2 is a fragmentary perspective view of the top corner of the door shown in FIG. 1.
FIG. 3 is a view similar to FIG. 2 showing the same corner of the do before application thereto of the trim members of the invention.
FIG. 4 is a fragmentary section on the line 4—4 of FIG. 1.
FIG. 5 is a detailed sectional view of the magnetic weather strip is also shown in FIG. 4.
FIG. 6 is an enlarged cross sectional view of one of the trim elements shown in FIG. 1.

Door 10 is shown in the drawings as constructed of a single piece of wood cut out to receive three small windows 11, but the principles of the invention are applicable to any door wherein the lock side, hinge side and top portion of the door are made of wood or other nonmagnetic material. For example, the invention is applicable to a panel door comprising a pair of stiles of wood cooperating with wood top and bottom rails to form the peripheral portion of the door which encloses a panel of some other material, e.g. glass or screening.

In FIG. 1, the door 10 is shown as an exterior door of a dwelling which is hinged along its right side for opening movement inwardly of a conventional door frame comprising a lock side jamb 12, a hinge side jamb 13, a top jamb 14 and a sill 15. The lock side jamb 12 is also shown in FIG. 4 as including a stop portion 16 which cooperates with magnetic weather stripping 20 to define the closed position of the door 10. The particular construction and mounting arrangement of the weather stripping 20 is not critical to the invention, an example of suitable such weather stripping being shown in Pease U.S. Pat. No. 3,238,573, but the weather stripping shown in FIGS. 4 and 5 has been developed to provide particularly effective sealing action with the doors of the invention.

As shown in detail in FIG. 5, the weather stripping 20 includes a strip of magnetic material 21 of rectangular section which is enclosed in a complementary rectangular envelope 22 forming a part of an extruded strip of suitable elastomeric material, such for example as olefin base thermal plastic elastomer. This strip includes a barbed fin 23 by which is mounted in a slot 24 along the inner edge of the stp 16, and a generally triangular shoulder 25 limits penetration of the fin 23 into the slot 24. The inside outer corner of the envelope 22 is connected by a curved strip 26 with the outer corner of the shoulder 25, and the diagonally opposite corner of envelope 22 is similarly connected to the same corner of shoulder 25 by another plastic strip having two angularly related sections 27 and 28.

FIG. 5 illustrates the weather stripping 20 in its free condition, wherein the strips 26 and 27–28 support the magnetic strip 21 in its envelope 22 in outwardly spaced relation from shoulder 25. In the closed position of the door, as illustrated in FIG. 4, the door forces the magnetic strip 21 and its envelope 22 and the plastic strip 27 against the stop 16. This movement of these portions of the weather stripping will cause the plastic strip 28 to lie against the outer face of shoulder 25. In addition, the edge of the door will compress the curved strip 26 against the side of the jamb 12 and thereby establish a compression weather seal which supplements the magnetic seal.

The primary component provided by the invention to the combination shown in the drawings is a right-angled clip-like trim strip 30 having two sides 31 and 32 which are at right angles to each other and combine to enclose the corner 33 of the door. Each of these sides 31 and 32 of the strip 30 is provided with an inwardly curled outer edge 35.

It is important for the purposes of the invention that the trim strip 30 be of magnetic material—in order to attract the magnetic weather stripping—as well as both hard and resilient, and it is also desired that it provide a decorative appearance in use. All of these requirements are met by constructing the trim strip of an inner layer 40 of magnetic stainless steel and an outer layer 41 of brass, e.g. with the inner layer 40 composed of 430 stainless steel 0.015 inch thick, and with the brass layer 41 having a thickness of 0.007 inch.

It is not necessary to the practice of the invention that the steel and brass layers 40 and 41 be bonded together. Rather, as shown in FIG. 6, the brass layer 41 should initially be sufficiently wider than the steel layer 40 so that when the two layers are superimposed and subjected first to the curling of their edges and then to their bending to the 90° final shape, the brass layer will be tensioned sufficiently to hold it in essentially continuous contact with the steel layer 40.

In order to mount the trip strip 30 on the door 10, the edge and outer face of the door are provided with vertical grooves 44 and 45 respectively, with these grooves being spaced to receive the curled edges 35 of the two sides of the trim strip, as shown in FIG. 4. Also, the outer face of the door and the surface of its edge portion between each groove 44 and 45 and the corner 33 of the door are relieved by an amount equal to the thickness of the trim strip 30, as indicated at 46 in FIG. 3, e.g. 0.022 inch.

The dimensions and locations of the grooves 44 and 45 are predetermined to assure firm mounting of the trim strip 30 on the door. As a preferred example, the width of each side of the strip 30 may be 0.340 inch, and the dimensions of each curled edge 35 identified as a and b in FIG. 6 may be 0.090 inch and 0.065 inch respectively. For a strip 30 of these dimensions, the depth of each of the grooves 44–45 should be sufficient to assure that the strip will engage firmly with the surfaces of the door with which it is supposed to be in contact, e.g. a depth of 0.100 inch and with the distance between the far side of each groove and the theoretical (unrelieved) location of corner 33 being 0.340 inch.

The width of each of the grooves 44-45 should be sufficiently less than the dimension b of each of the curled edges 35 to assure that some degree of compression of these curled edges will be necessary while they are being inserted in the grooves, in order to assure that they will be securely held in place. For example, a width of 0.062 inch has been found satisfactory where the dimension b is 0.065 inch. As a further precaution, the inner surfaces of the sides 31-32 of each strip may be coated with a suitable structural adhesive before the strip is pressed into place.

The same arrangement of trim strips is provided along the top and the hinge side of the door, as shown at 50 and 51 in FIGS. 1 and 2. For this purpose, the groove 44 in the edge of the door is continued across the top and down the hinge side edge of the door, the face of the door is provided with a groove 52 just below its top edge, and a groove 55 corresponding to the groove 45 is provided along the face of the door adjacent its hinge side and receives the mounting flanges on the front side of the trim strip 51. Normally, however, the magnetic weather stripping 20 will also be installed along the top jamb 14, but the weather stripping along the hinge side jamb 13 will be of a compression type, such as shown in FIG. 5 of the above Pease U.S. Pat. No. 3,238,573.

With this complete coverage of the top and both side edges of the face of the door which enters the frame, assurance is provided that there will be proper magnetically sealing engagement between the top edge of the door and magnetic weather stripping mounted in the same manner as shown in FIG. 4 along the top jamb 14. Further, warping of the door such as often occurs with a wood door will not affect the sealing action of the magnetic weather stripping, because it is able to deform itself to the extent necessary to remain in magnetic engagement with all of the magnetic strips of the invention. In addition, with all three of the edges of the door covered by trim strips, they are provided with maximum protection from damage by any foreign object which might be caught between them and the door frame, and also either side edge may be used as the lock side as the door is equipped with hardware for mounting in a door frame.

As discussed above, the invention has a special applicability to wood doors, because of their non-magnetic nature. It is similarly applicable to doors wherein the stile along the lock side and the top rail are of other non-magnetic material, such particularly as plastic. While the articles herein described constitute preferred embodiments of the invention, it is to be understood that the invention is not limited to these precise articles, and that changes may be made therein without departing from the scope of the invention which is defined in the appended claims.

What is claimed is:

1. A door for hinged mounting in a frame including a lock side jamb, a hinge side jamb, a top jamb and a sill cooperating to define a door opening, each of said jambs including a stop establishing the closed position of a door mounted in said frame, and each of said lock side and top jambs being provided with magnetic weather stripping mounted to overlie said stop portion thereof, (a) said door having at least the peripheral portions of the top and lock side edges made of non-magnetic material, (b) said door having a face designated for engagement with said stops such that said top and lock side edges interfit with said top and lock side jambs in the closed position of said door, (c) clip-like trim means of relatively hard magnetic metal having a vertical portion extending in enclosing relation with the corner of the lock side edge and the face of said door and having a horizontal portion extending in enclosing relation with the corner of the top edge and the face of said door for magnetically sealing engagement with said weather stripping, (d) each said trim means portion being a strip of said metal having in cross section a substantially L-shaped configuration providing said strip with two sides, said strip having a flange along the outer edge of each of the two sides of said L-shape extending inwardly of said L-shape, (e) said face and edges of said door each having a groove therein positioned to receive a respective said flange of said trim means, each of said flanges including an inwardly-curled edge portion having a total width equal to slightly more than the width of, and being compressed between the sides of, said groove in which the flange is received to secure said trim means to said door, and (f) the areas of said door face and edges enclosed by said strips being relieved to a sufficient extent to cause the outer surfaces of said strips to be substantially coplanar with the adjacent surfaces of said face and edge portions of said door.

2. A door as defined in claim 1 further characterized in that said trim means comprises an inner layer of magnetic metal and an outer layer of decorative material completely overlying and secured to said inner layer.

3. A door as defined in claim 2 wherein said inner layer is composed of magnetic stainless steel, and said outer layer is composed of brass.

4. A door as defined in claim 1 wherein said peripheral portions of said door are of wood.

5. A door for hinged mounting in a frame including a lock side jamb, a hinge side jamb, a top jamb and a sill cooperating to define a door opening, each of said jambs including a stop establishing the closed position of a door mounted in said frame, and each of said lock side and top jambs being provided with magnetic weather stripping mounted to overlie said stop portion thereof, (a) said door having at least the peripheral portions of the top and lock side edges made of non-magnetic material, (b) said door having a face designated for engagement with said stops such that said top and lock side edges interfit with said top and lock side jambs in the closed position of said door, (c) clip-like trim means having a vertical portion extending in enclosing relation with the corner of the lock side edge and the face of said door and having a horizontal portion extending in enclosing relation with the corner of the top edge and the face of said door for magnetically sealing engagement with said weather stripping, (d) each said trim means portion being a two-layer strip having in cross section a substantially L-shaped configuration providing said strip with two sides, said strip having a flange along the outer edge of each of the two sides of said L-shape extending inwardly of said L-shape, (e) said face and edges of said door each having a groove therein positioned to receive a respective said flange of said trim means, (f) the areas of said door face and edges enclosed by said strips being relieved to a sufficient extent to cause the outer surfaces of said strips to be substantially coplanar with the adjacent surfaces of said face and edge portions of said door, and (g) each said two-layer strip comprising an inner layer composed of relatively hard magnetic stainless steel and an outer layer composed of brass and completely overlying and secured to said inner layer, wherein said outer layer is substantially wider than said inner layer to provide marginal portions thereof which are wrapped around the edges of said inner layer.

6. A door as defined in claim 5 wherein said brass layer is under tension holding the inner surface thereof in close contact with the adjacent surface of said steel layer.

7. A door for hinged mounting in a frame including a lock side jamb, a hinge side jamb, a top jamb and a sill cooperating to define a door opening, each of said jambs including a stop establishing the closed position of a door mounted in said frame, and each of said lock side and top jambs being provided with magnetic weather stripping mounted to overlie said stop portion thereof, (a) said door having at least the peripheral portions of the top and lock side edges made of non-magnetic material, (b) said door having a face designated for engagement with said stops such that said top and lock side edges interfit with said top and lock side jambs in the closed position of said door, (c) clip-like trim means having a vertical portion extending in enclosing relation with the corner of the lock side edge and the face of said door and having a horizontal portion extending in enclosing relation with the corner of the top edge and the face of said door for magnetically sealing engagement with said weather stripping, (d) each said trim means portion being a two-layer strip having in cross section a substantially L-shaped configuration providing said strip with two sides, said strip having a flange along the outer edge of each of the two sides of said L-shape extending inwardly of said L-shape, (e) said face and edges of said door each having a groove therein positioned to receive a respective said flange of said trim means, (f) the areas of said door face and edges enclosed by said strips being relieved to a sufficient extent to cause the outer surfaces of said strips to be substantially coplanar with the adjacent surfaces of said face and edge portions of said door, and (g) each said two-layer strip comprising an inner layer composed of relatively hard magnetic stainless steel and an outer layer composed of brass and completely overlying and secured to said inner layer, wherein the outer edges of said trim strip are curled inwardly of said strip, and said brass layer is sufficiently wider than said steel layer to provide marginal portions thereof which are curled around the edges of said steel layer and extend therebeyond into the interior of said rolled edges.

8. A door as defined in claim 7 wherein said curled edges of said strip have a total width equal to slightly more than the width of said groove and are compressed between the sides of said groove to secure said trim strip to said door.

9. In a door assembly including a frame comprising a lock side jamb, a hinge side jamb, a top jamb, and a sill cooperating to define the door opening, a door hingedly mounted on said hinge side jamb and having at least the peripheral portions of the top and lock side edges thereof made of non-magnetic material, each of said jambs including a portion forming a stop establishing the closed position of said door, said door having a face designated for engagement with the said stops, and each of said lock side and top jambs being provided with magnetic weather stripping mounted to overlie said stop portion thereof, the improvement comprising:

(a) clip-like trim means of relatively hard magnetic metal having a vertical portion extending in enclosing relation with the corner of the lock side edge and the face of said door adjacent said lock side jamb stop and having a horizontal portion extending in enclosing relation with the corner of the top edge and the face of said door adjacent said top jamb stop for magnetically sealing engagement with said weather stripping, (b) each said trim means portion being a strip of said metal having in cross section a substantially L-shaped configuration, (c) each of the two sides of each said L-shaped strip being of a width substantially equal to the width of one of the top jamb and lock side jamb stops, each said strip having a flange along the outer edge thereof extending inwardly of said L-shape, (d) said face and edges of said door each having a groove therein positioned to receive a respective said flange of said trim means, (e) the surface portions of said face and edges of said door enclosed by said strips being relieved with respect to the adjacent surface portions thereof to a depth substantially equal to the thickness of said trim means, and (f) means cooperating with said grooves and said flanges for retaining said flanges in said grooves to secure said trim means with the outer surfaces thereof substantially flush with the adjacent surfaces of the face, top edge, and the lock side edge of said door.

* * * * *

UNITED STATES PATENT AND TRADEMARK OFFICE

CERTIFICATE OF CORRECTION

PATENT NO. : 4,947,585

DATED : August 14, 1990

INVENTOR(S) : Norbert J. Guetle, Jr.

It is certified that error appears in the above-identified patent and that said Letters Patent is hereby corrected as shown below:

Col. 2, line 22, "do" should be --door--.

Col. 2, line 22, before "before" insert --but--.

Col. 2, line 27, "strip" should be --stripping--.

Col. 2, line 27, before "is also shown" insert --which--.

Col. 3, line 25, after "edge 35" insert --which forms a flange projecting generally at right angles from the adjacent side 31 or 32 inwardly of the L-shape of the strip--.

Signed and Sealed this

Twenty-eighth Day of April, 1992

*Attest:*

HARRY F. MANBECK, JR.

*Attesting Officer*

*Commissioner of Patents and Trademarks*